US005829099A

United States Patent [19]

Kopelman et al.

[11] Patent Number: 5,829,099

[45] Date of Patent: Nov. 3, 1998

[54] UNIVERSAL ERGONOMIC HANDLE

[76] Inventors: Larry J. Kopelman, 183 Hidden Ct., Old Bridge, N.J. 08857; Donald G. Helt, III, 101 Woodvale Ave., Staten Island, N.Y. 10309

[21] Appl. No.: 840,175

[22] Filed: Apr. 14, 1997

[51] Int. Cl.[6] ..... A47B 95/02

[52] U.S. Cl. ..... 16/111 R; 16/110 R

[58] Field of Search ..... 16/111 R, 110 R, 16/DIG. 12, DIG. 19; 81/489, 436, 177.1; 76/106, 119; D7/688, 691, 368, 369, 393, 395; D8/107

[56] References Cited

U.S. PATENT DOCUMENTS 3,269,399 8/1966 Smith ..... 16/111 R
5,125,130 6/1992 Stanish ..... 16/110 R
5,425,176 6/1995 Brainerd et al. ..... 81/489
5,470,108 11/1995 Goode et al. ..... 16/111 R

*Primary Examiner*—Chuck Y. Mah
*Attorney, Agent, or Firm*—Charles I. Brodsky

[57] ABSTRACT

An ergonomic handle design in which the contours of the handle are matched with the anatomy of the hand, taking into account the dynamics of the kinesiology of movement and the physiology of the joints so that muscles are not overtaxed. In the preferred embodiment described, the surface area of the handle is balanced out over the thenar eminance, while its curvatures accommodate the web space between the thumb and the fingers as well as the pads over the metacarpal heads in an efficient manner. The fingers then naturally wrap around the gripping surface of the handle without undue stress on the proximal and interphalangial joints.

10 Claims, 4 Drawing Sheets

| | A LITTLE FINGER LENGTH | B MIDDLE FINGER LENGTH | C INDEX FINGER LENGTH | D THUMB/LITTLE DIAMETER | E THUMB/MIDDLE DIAMETER | F THUMB/INDEX DIAMETER |
|---|---|---|---|---|---|---|
| | in. | in. | in. | in. | in. | in. |
| 95% US MALE | 2.8 | 3.7 | 3.3 | 1.53 | 2.2 | 1.8 |
| 50% US MALE | 2.5 | 3.3 | 3 | 1.33 | 1.9 | 1.6 |
| 5% US FEMALE | 2 | 2.7 | 2.5 | 1.04 | 1.6 | 1.3 |
| | | | | | | |
| BREADTH AT: | G | H | I | | | |
| .495 OF 95% | 1.386 | 1.83 | 1.63 | | | |
| .495 OF 50% | 1.238 | 1.634 | 1.485 | | | |
| .495 OF 5% | 0.99 | 1.337 | 1.238 | | | |
| | | | | | | |
| BREADTH AT: | | | | J | K | L |
| .928 AT 95% | | | | 1.42 | 2.04 | 1.67 |
| .928 AT 50% | | | | 1.23 | 1.763 | 1.485 |
| .928 AT 5% | | | | 0.97 | 1.48 | 1.2 |

*FIG. 6*

UNIVERSAL ERGONOMIC HANDLE

FIELD OF THE INVENTION

This invention relates to such repetitive motion injuries as Carpal Tunnel Syndrome, Tenosynovitis and Lateral Epicondylitis and, more particularly, to the design of an ergonomic handle to reduce such cumulative trauma by making tool movements more efficient, less energy consuming and less fatiguing.

BACKGROUND OF THE INVENTION

As has been reported, Carpal Tunnel Syndrome and other cumulative trauma disorders constitute the fastest growing problem in the industrial work place. Numerous studies have suggested that these injuries are related to repetitive motions over time, uses of excessive force, and/or abnormal positioning of the body and joints during work. Analysis has shown, however, that the designs of modern tools for different jobs by-and-large have caused these injuries, have increased the severity of them, and/or pre-disposed workers to circumstances leading to them. In fact, one study suggests that over the past 10 years, or so, there has been a ten-fold increase in these Cumulative Trauma Disorders.

Evidence has surfaced that tool redesign and enhancements can reduce the severity and impact of the hazard. Such evidence indicates that a pro-active approach to ergonomic intervention in implementing redesigned tools could be an effective deterrent to such debilitating and costly injuries associated with work place tasks.

In evaluating the problem to arrive at an effective tool redesign, a scientific approach to various subcomponents has been indicated to be helpful. For example, a determination would be desirable in finding which muscles are involved in grasping, and then verifying that there are differences that follow from a grasping of a non-ergonomic handle and an ergonomic handle. Analysis in determining how strongly the muscles contract is yet another helpful fact to consider, and then being able to quantify muscle functions and differences when using a non-ergonomically designed handle and one which is ergonomically designed. A prediction of fatigue rates then is beneficial, in comparing usage with ergonomically designed handles and those which are non-ergonomically designed, so that a true physiological measure of fatigue can be attained. Lastly, data collected from participants in a study could be correlated both subjectively and objectively to determine if perceived exertions match physiological measures.

OBJECTS OF THE INVENTION

Taking all the foregoing into consideration, it is an object of the present invention to reduce the incidence of Cumulative Trauma Disorders—and to do so by tool redesign.

It is another object of the invention to provide an ergonomic handle for reducing such disorders, which will be more efficient as a tool, and have applications to a variety of tool uses.

It is also an object of the invention to provide such an ergonomic handle which requires less muscular effort to use than is attendant with non-ergonomic handles of the type used in the prior art.

It is yet another object of the invention to provide such an ergonomic handle useful for hand and power tools alike, for medical devices, for kitchen utility devices, and for many other applications of use, both in an industrial environment, in commercial utilizations, and for home utility as well.

It is still another object of the invention to provide a type of ergonomic handle of the kind described for accommodating those who are both left and right hand dominant, and to meet the needs of users in the 5th to 95th percentile wrist and hand size, of both genders.

It is yet an additional object of the invention to provide such a universal, ergonomic handle that obviates the changes caused by repetitive motion disorders due to both mechanical and physiological factors of the type that cause stress and strain upon the tissues of the body as lead to various types of deformation, even though such changes may otherwise take weeks, months and even years to manifest itself.

SUMMARY OF THE INVENTION

These and other objects of the invention will be seen to be satisfied through an ergonomic handle design in which the contours of the handle are matched with the anatomy of the hand—taking into account the dynamics of the kinesiology of movement and the physiology of the joints so that the muscles are not overtaxed. In the preferred embodiment to be described, the surface area of the handle will be seen to be balanced out over the thenar eminance, while its curvatures accommodate the web space between the thumb and the fingers, as well as the pads over the metacarpal heads in an efficient manner. With the pads then providing the stability and grip, the fingers will be seen to naturally wrap around the surface of the handle without any undue stress being produced on the proximal and distal inter-phalangial joints in providing an optimum contour. As will also be described, a convex line is provided in the anterior surface of the handle to accommodate the proximal and distal inter-phalangial joints and the skin pads in the front, while the concave back surface of the handle accommodates the thenar eminance at the base of the thumb, so that no stress results. Similarly, the valleys on the posterior surface accommodate the palmar curve, which naturally forms on the lateral surfaces when gripping.

As will become clear hereinafter, the ergonomic handle of the invention thus accommodates both the left-hand and the right-hand group for use by left and right dominant persons, or by those who are ambidextrous—both with the same efficiency. As will also be described, the ergonomic handle of the invention puts the wrist in a neutral position, instead of being radially deviated, as when using a standard cylindrical, or 90° handle, in a stressful position.

In such manner, as will be appreciated, the ergonomic handle of the invention will also be seen as useful in such varied applications as in just carrying luggage, or attache cases about, as in operating jackhammers or other heavy industrial equipment, even while wearing protective gloves.

BRIEF DESCRIPTION OF THE DRAWINGS

These and other features of the present invention will be more clearly understood from a consideration of the following description, taken in connection with the accompanying drawings in which:

FIG. 6 is a table of typical dimensions of the hand useful in appreciating the invention.

DETAILED DESCRIPTION OF THE DRAWINGS

Figure 1A:
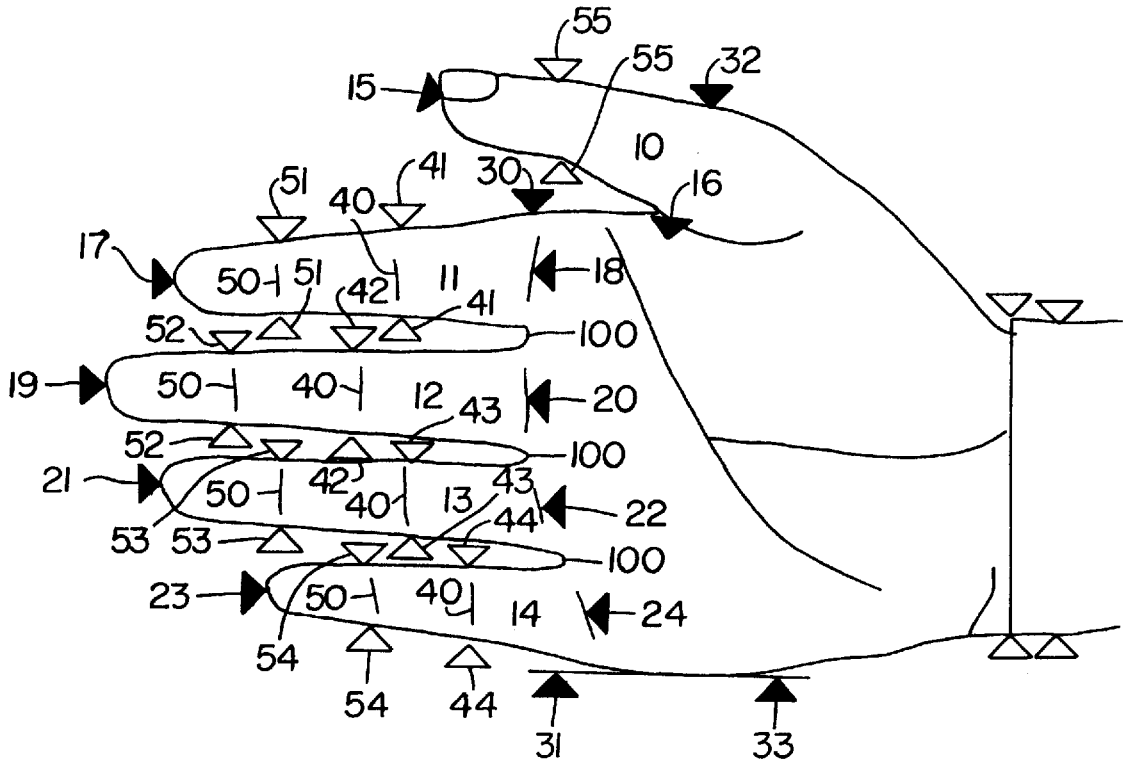
FIGS. 1A and 1B are illustrations of a hand and its anthropometrics helpful in an understanding of the ergonomic handle of the invention.

In the illustrations of FIG. 1 of the right-hand (similar for a left-hand), the thumb, index finger, middle finger, ring finger and little finger are shown by reference numerals 10–14, respectively. The anthropometrics for the hand include such items as the thumb finger length, the index finger length, the middle finger length, the ring finger length and the little finger length. Referring to FIG. 1A, the thumb length will be appreciated to be measured from the tip 15 of the thumb 10 to the base 16 of the thumb 10 at the level of the skin web between the thumb 10 and the index finger 11, with the thumb 10 being held straight. The index finger length will similarly be understood to be measured from the tip 17 of the index finger 11 to the base 18 of the finger 11 at the level of the skin web between the finger 11 and the middle finger 12, with the index finger 11 being held straight. The middle finger length, in similar manner, will be appreciated as being measured from the tip 19 of the middle finger 12 to the base 20 of the finger 12 at the level of the skin web between the finger 12 and the neighboring fingers, with the middle finger 12 being held straight. Likewise, the ring finger length will be appreciated to be measured from the tip 21 of the ring finger 13 to the base 22 of the finger 13 at the level of the skin web between it and the neighboring fingers, with the ring finger 13 being held straight. Lastly, the little finger length will be understood to be measured from the tip 23 of the little finger 14 to the base 24 of the finger 14 at the level of the skin web between the finger 14 and the ring finger 13, with the little finger 14 being held straight. In FIG. 1A, the skin web between the various fingers is noted at 100.

Figure 1B:
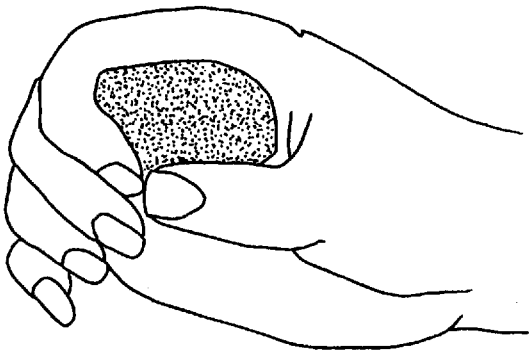
Figure 5:
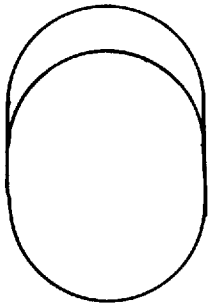
FIGS. 2–5 show left-side (a right-side being a mirror image), front (the back being a mirror image), top and bottom views of the ergonomic handle, respectively.
Figure 4:
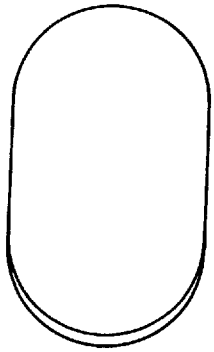

As will become clear, the anthropometrics of the hand of FIGS. 1A and 1B also includes other components helpful in visualizing the invention. Such components include the measurements of the hand breadth across the finger knuckles, the hand breadth including the thumb, the thumb-middle finger grip diameter and the thumb-index finger grip diameter. Referring to FIG. 1A, the "hand breadth across the finger knuckles" is measured across the palm of the hand, between points 30 and 31, at the junction between the palm and the fingers (not including the thumb), and with the hand flat. The "hand breadth including the thumb" will be understood to be measured across the palm of the hand, between the points 32, 33, at the level of the base of the thumb and including the joint at the base of the thumb 10. The "thumb-middle finger grip diameter" will be appreciated as being measured by grasping a cone at the largest circumference permitting the tips of the thumb 15 and of the middle finger 19 to touch. The "thumb-index finger grip diameter" will be appreciated to be measured by grasping a cone at the largest circumference permitting the tips of the thumb 15 and the index finger 17 to touch. The "thumb-little finger grip diameter" will be appreciated to be measured by grasping a cone at the largest circumference permitting the tips of the thumb 15 and little finger 23 to touch. See FIG. 1B.

The proximal joints for the index finger 11, the middle finger 12, the ring finger 13 and the little finger 14 are shown by the reference numeral 40—and are of breadths measured between the points 41, 42, 43 and 44, respectively. The distal joints for the index finger 11, the middle finger 12, the ring finger 13 and the little finger 14 are shown by the reference numeral 50—and are of breadths measured between the points 51, 52, 53 and 54, respectively. The breadth of the thumb 10 at its proximal joint is shown as being measured between the reference points 55.

As is well known, tools and handles are meant to increase a human's productivity by extending and amplifying the manipulative ability of the hand. However, few guidelines exist to help workers select tools that are both effective and safe to use—with past reliance being primarily by trial and error to find tools which were comfortable for employment. Most often, the tool selected was based upon how it felt, how it was balanced, its weight and shape, without any determination as to whether the tool would be effective, would aid in productivity, or would minimize the development of fatigue and physical stress over the course of a work-day's use. With respect to the ergonomic handle of the invention to be described below, principles employed will be appreciated by those skilled in the art to avoid high contact forces and static loading of the muscles in holding and gripping the tool, to avoid extraneous and awkward postures of the joints, and to avoid repetitive finger action and tool vibration.

In accordance with the invention, shown in FIGS. 2–5, the ergonomic handle is designed for a power grip in which the hand wraps around the handle, being clamped between party flexed fingers and the palm with the thumb opposing the grip, and with the handle lying along the plane of the palm. Such handles allowing power-grips have been determined herein to be less fatiguing than other grips, and because they require a lower percentage of a worker's total gripping effort—meaning that less effort is used to control the tool.

Also in accordance with the invention, the ergonomic handle is substantially cylindrical, and/or oval, with a diameter of between 30 mm.–45 mm. (1.25 in.–1.75 in.) for optimum grip control without sacrificing torque capability for the majority of the population, fitting the 5th to 95th percentile of males and females. Also, according to the preferred embodiment prescribed, the handle length should be 100 mm. minimum to meet the requirements of the average male or female hand at four inches across the width of the palm—but preferably should be between 115 mm.–120 mm. (5 in.), to allow freedom of use and so that the handle does not interfere with other activities. (If gloves are to be worn when utilizing the handle, obviously, accommodation should be designed to meet the increased girth needed.)

In constructing the handle design of the invention, textured or rubber handles are preferable to provide that friction associated with good grip. All sharp edges are avoided, and in a design which is characterized by the absence of any pressure exerted on the sides of the fingers. The curvature of the handle, if it is incorporated into the design, is not to exceed more than 0.5 inches in its entire length, with any high points of the handle being at the palm of the hand and the middle fingers. If a flange is to be used, the design of the invention will be seen to incorporate it at the base of the handle, in order to offer increased stability, particular where downward forces are to be generated with the tool. In the preferred embodiment, the handle follows the natural contour of the palmar curve and the fingers at the thenar eminance. Furthermore, and in accordance with the invention, the handle diameter will be appreciated as to not exceed 40 mm. (1.5 in.), with 30 mm.–50 mm. (1.25 in.–2.0 in.) as an average for use by 5th–95th percentiles males and females. Although the preferred embodiment utilizes a textured or rubber handle, in general one's that are non-porous, non-slip and non-conductive to heat, cold and electricity are to be utilized.

The definitions employed with reference to FIG. 1, and their use in developing the ergonomic handle of FIGS. 2–5, can be understood by reference to the table of FIG. 6, showing lengths and other measurements, in inches, of the hand for a United States male in the 95th percentile, for a United States male in the 50th percentile, and for a United States female in the 5th percentile. The little finger length A represents that measurement between the tip 23 of the little finger 14 and the base 24 of such finger. The middle finger length B represents the measurement from the tip 19 of the middle finger 12 to its base 20. The index finger length C is measured from the tip of the index finger 17 to its base 18. The thumb-little finger grip diameter D is that between the tip of the thumb 15 and the tip of the little finger 23 when a cone of the largest circumference is grasped permitting the tips 15 and 23 to touch. The thumb-middle finger grip diameter E is the measurement between the tip of the thumb 15 and the tip of the middle finger 19 when a cone of the largest circumference is grasped permitting the tips 15 and 19 to touch. The thumb-index finger grip diameter F is the measurement between the tip of the thumb 15 and the tip of the index finger 17 when grasping a cone at that largest circumference which permits those tips to touch. See FIG. 1B.

The hand breadth across the knuckle of the little finger 14 is shown for these three percentiles at G, whereas the hand breadth across the knuckle of the middle finger 12 is shown at H. At I is shown the hand breadth across the knuckle of the index finger 11. Similarly, the hand breadth, measured across the palm of the hand at the level of the base of the thumb 10, and including the joint at the base of the thumb 10, is shown at J, K and L when measured with respect to the little finger 14, middle finger 12 and index finger 11, respectively. See FIG. 6.

In accordance with the invention, the ergonomic handle is of elliptical cross-section having no sharp edges. As appreciated, such ellipse is defined mathematically as the path of a point moving in such a way that the sum of the distances from two focal points is constant, and consists of two primary lengths of diameters, the major diameter and the minor diameter. Secondly, in constructing the preferred embodiment of the handle of the invention, the hand anthropometrics of a United States male, age 18–64 in the 50th percentile is employed. Third, in accordance with the invention, the major diameter for the elliptical cross-section of the handle is selected by multiplying the specific finger length that is relevant to its position on the handle, by a factor of 0.5 (50%). Fourth, the minor diameter of the elliptical cross-section of the handle is selected by multiplying by 0.5 (50%) the numeric value of the area ($A=\pi r^2$) formed by joining that finger in question with the thumb. Stated as a theorem, the ergonomic handle of the invention is preferably of an elliptical cross-section in accordance with the formula:

$$\frac{\text{Major Diameter } (\varnothing_{maj})}{\text{Minor Diameter } (\varnothing_{min})} = \frac{(0.5)\text{ Length of Finger } (L_f)}{(0.5)\text{ Area of Thumb/Finger}} = \frac{L_f}{A_{tf}}$$

Where $L_f$ represents the length of finger in question and where $A_{tf}$ represents the area formed by joining that finger with the thumb.

FIGS. 2–5 respectively show the left side, front, top and bottom views of an ergonomic handle according to this theorem, and to the invention.

Figure 3:
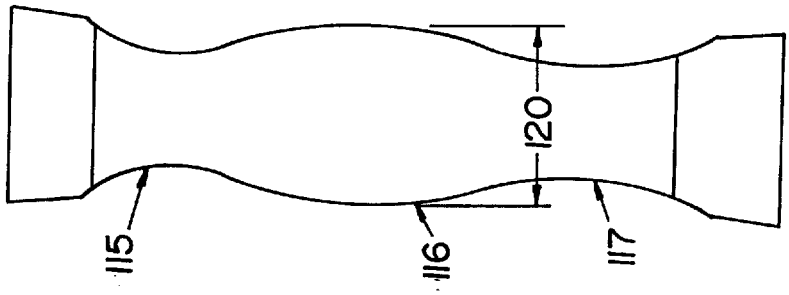
Figure 2:
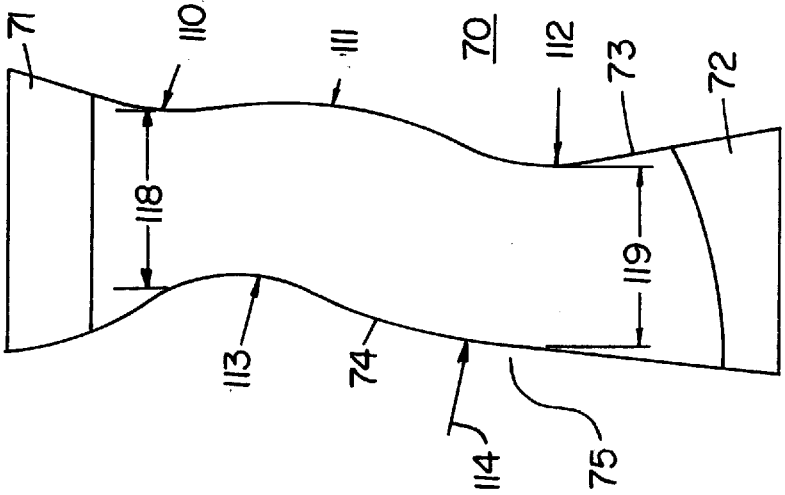

Shown generally at 70, the handle incorporates a flat top 71, and a lower flange 72 which is angled rearwardly, as at 73, as a safety feature in preventing the user's losing grip and slipping off the tool. A convex line 74 in the front (anterior) accommodates the proximal and distal interfallangial joints of the fingers and the skin pads in the front 75 and a concave back surface 76 accommodates the thenar eminance at the base of the thumb 10 to reduce stress. Although not shown as such, it will be appreciated that a series of valleys are incorporated on the lateral surfaces of the handle 70 to accommodate the palmar curve that is naturally formed in gripping the handle, both by left-dominant or right-dominant (or ambidextrous) persons. In accordance with the design of the handle of the invention, the elliptical curvature of the handle 70 for both major diameter and minor diameter (FIGS. 2, 3) are calculated and determined for each finger length, and for each thumb-finger area positioning, wherever selected, for the user in question, changing the ratio between the major and minor diameters along its length for each finger. For a United States male, age 18–64, in the 50th percentile, FIGS. 2–3 show the major diameters (FIG. 2) and minor diameters (FIG. 3) at the locations shown as indicated at illustrative points 110–114 and at illustrative points 115–117, respectively. Such diameters, for the 50th percentile of United States male, are as follows, for the locations selected arbitrarily along the length of the handle 70, changing the ratio of major diameter to minor diameter for each finger position.

Arc Diameter at 110 . . . 3.0117 inch
Arc Diameter at 111 . . . 7.1250 inch
Arc Diameter at 112 . . . 3.0287 inch
Arc Diameter at 113 . . . 3.0000 inch
Arc Diameter at 114 . . . 10.0849 inch
Arc Diameter at 115 . . . 2.4375 inch
Arc Diameter at 116 . . . 6.6875 inch
Arc Diameter at 117 . . . 4.8125 inch Reference numerals 118, 119 and 120 identify diameters of 1.4854, 1.5724 and 1.5964 inches, respectively, where the arc diameters 110, 112 and 116 were measured.

Figure 7:
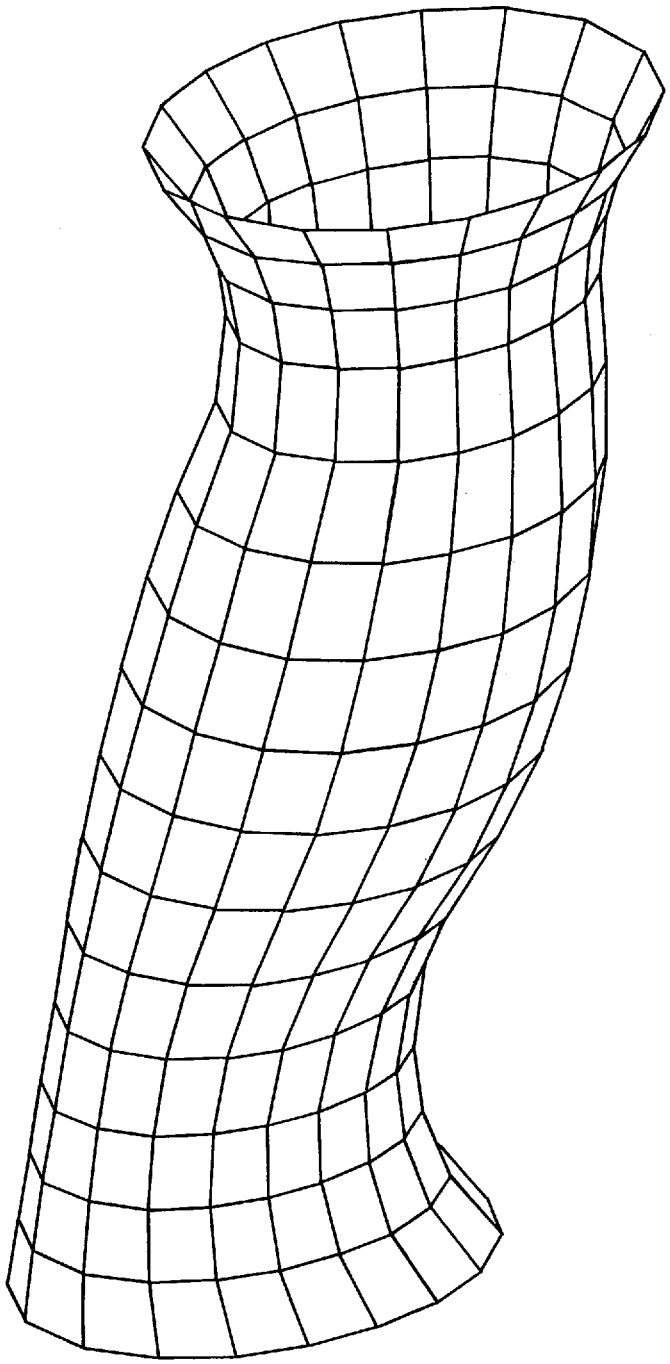
FIG. 7 is a perspective view of the handle of the invention.

While there has been described what is considered to be a preferred embodiment of the present invention, it will be readily appreciated by those skilled in the art that modifications can be made without departing from the scope of the teachings herein. Thus, although variations can be made with respect to the diameters of the handles employed, in the lengths of their grips and in the materials of which they are made, as long as the handle is of an elliptical cross-section, and in which the major diameter-to-minor diameter ratio changes for each finger positioning, the end result is a reduction in potential impingement and trauma. The formulas and curves employed, along with the anterior and posterior designs, all allow for maximum flexion of the fingers, in maintaining the palmar arch without impingement and in good alignment of the phalanges. With the handle held in the proper posture for-power grip, analysis has shown there to be a neutral position of the wrist resulting, eliminating ulna and radial deviation, and the potential for trauma from maladapted positions at work, without there being any compression of the tendons of the finger flexors, while the potential for tendonitis and carpal tunnel syndrome is reduced. The proximal medial and lateral curves described allow for comfort at the web space and prevention of slippage of the handle, with the distal curve and flair allowing for safety and prevention of the handle from slipping when force is applied in a downward direction, while maintaining a flow of blood with the fingers hyperflexed to allow for maximum muscle force to be generated, for longer periods of time without fatigue. As the foregoing notes, all this is accomplished by selecting the elliptical cross-section to have ratios of major and minor diameter which are controllably altered, in accordance with the ratio between the length of the finger under consideration, with respect to the area encompassed by joining that finger with the thumb. For all the foregoing reasons, therefore, resort should be had to the claims appended hereto for a true understanding of the scope of the invention, the principles of which are depicted in the perspective view of FIG. 7.

I claim:

1. A handle comprising an elongate one-piece body including:

finger-side and thumb-side surfaces, front and back surfaces joining said finger-side and thumb-side surfaces, and top and bottom surfaces adjoining said finger-side, thumb-side, and front and back surfaces;

wherein said one-piece body is of a elliptical cross-section therethrough defined by major and minor diameters ϕmaj and ϕmin, respectively;

wherein the ratio between said major diameter and said minor diameter differs along the length of said elongate one-piece body; and wherein the ratio between said major diameter to said minor diameter differs along the length of said elongate body in accordance with the ratio at each point along the length of said body between the length $L_f$ of a finger of a hand grasping said body at said finger side at each point and the area $A_{tf}$ encompassed between the tip of the thumb of said hand and the tip of said finger extended to contact said tip of said thumb when grasping said body about said thumb-side surface at said point expressed as $$\frac{\varnothing_{maj}}{\varnothing_{min}} = \frac{L_f}{A_{tf}} .$$

2. The handle of claim 1 wherein said front surface of said elongate body includes an inwardly extending curve adjacent to said top surface of said body, and an outwardly extending curve adjacent to said bottom surface of said body.

3. The handle of claim 2 wherein said back surface of said elongate body includes an outwardly extending curve adjacent to said top surface of said body, and an inwardly extending curve adjacent to said bottom surface of said body.

4. The handle of claim 1 wherein said elongate one-piece body is at least 100 mm. in length.

5. The handle of claim 4 wherein said one-piece body is of a length between 115 mm. and 120 mm.

6. The handle of claim 1 wherein said elongate one-piece body is of a major diameter not less than 40 mm.

7. The handle of claim 6 wherein said one-piece body is of a major diameter between 30 mm. and 50 mm.

8. The handle of claim 1 wherein said elongate one-piece body is of non-porous, non-slip composition, non-conductive to heat, cold and electricity.

9. The handle of claim 8 wherein said one-piece body is of textured material.

10. The handle of claim 9 wherein said one-piece body is of a rubber fabrication.

* * * * *